United States Patent [19]

Simon

[11] 4,216,362

[45] Aug. 5, 1980

[54] SERIES SLIDING CONTACT SWITCH

[76] Inventor: Sydney S. Simon, 10911 NW. 24th St., Coral Springs, Fla. 33065

[21] Appl. No.: 958,261

[22] Filed: Nov. 6, 1978

Related U.S. Application Data

[63] Continuation-in-part of Ser. No. 788,108, Apr. 14, 1977, abandoned.

[51] Int. Cl.[2] ..... H01H 15/04; H01H 63/02

[52] U.S. Cl. ..... 200/153 S; 200/163; 200/307; 200/333

[58] Field of Search ..... 200/153 S, 163, 307, 200/333, 5 B, 18, 50 C; 333/97 S

[56] References Cited

U.S. PATENT DOCUMENTS

| | | | |
|---|---|---|---|
| 992,478 | 5/1911 | Birnn | 200/163 |
| 1,340,788 | 5/1920 | O'Hara | 200/163 |
| 2,277,645 | 3/1942 | Johnson | 200/18 X |
| 2,426,186 | 8/1947 | Dow | 200/153 S X |
| 2,465,039 | 3/1949 | Reynolds | 200/307 |
| 2,773,949 | 12/1956 | Edmunds | 200/18 |
| 2,795,144 | 6/1957 | Morse | 200/333 X |
| 3,010,080 | 11/1961 | Concelman | 200/153 S X |
| 3,991,293 | 11/1976 | Legeay et al. | 200/153 S |

FOREIGN PATENT DOCUMENTS

| | | | |
|---|---|---|---|
| 594064 | 3/1960 | Canada | 200/153 S |
| 1004343 | 1/1977 | Canada | 200/307 |

*Primary Examiner*—Stephen Marcus
*Attorney, Agent, or Firm*—Malin & Haley

[57] ABSTRACT

A series sliding, single pole contact switch including a generally slotted captivating input contact pin, at least one generally slotted captivating output contact pin, a sliding contact mechanism including a sliding knife blade contact and a switching assembly. The axially moveable sliding knife blade contact is always in captivated contact with the slotted captivating input contact pin, and the switching assembly is biased to place one end of the sliding knife blade contact in engagement with one of the slotted captivating output contact pins or to brace the sliding knife contact in the opposite direction. The switch may be gang connected to other switches, and may be switched by a single switching assembly. The switch is sealed to insure the water tight integrity of the unit.

5 Claims, 10 Drawing Figures

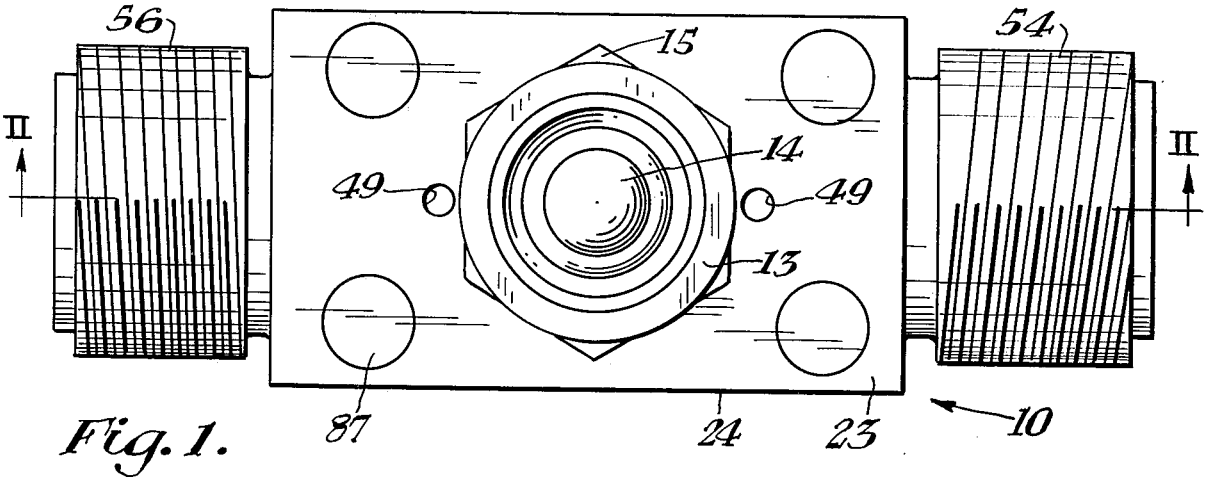
Fig. 1.
Fig. 4.
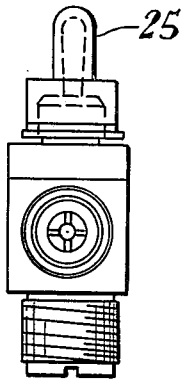
Fig. 3.
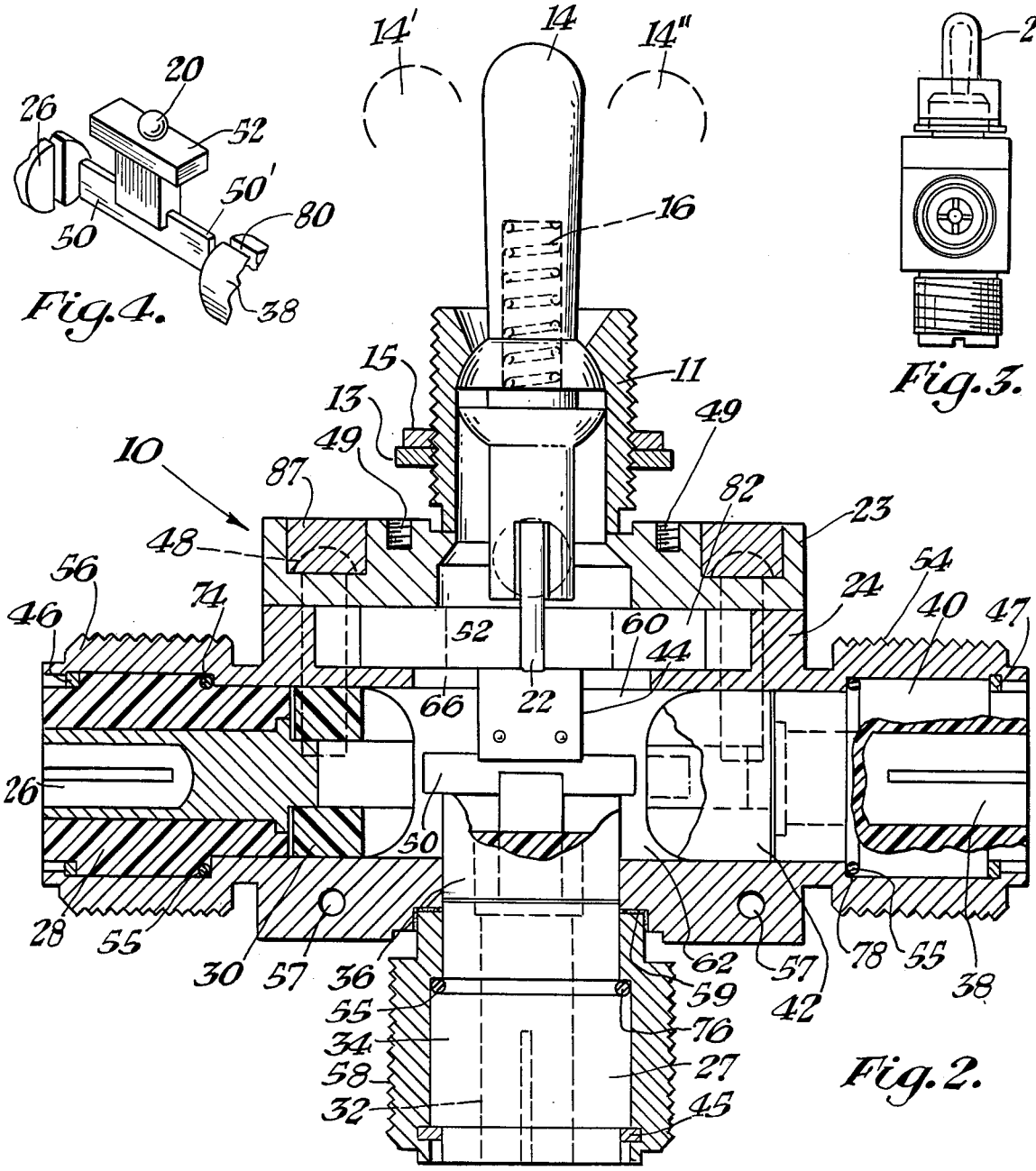
Fig. 2.

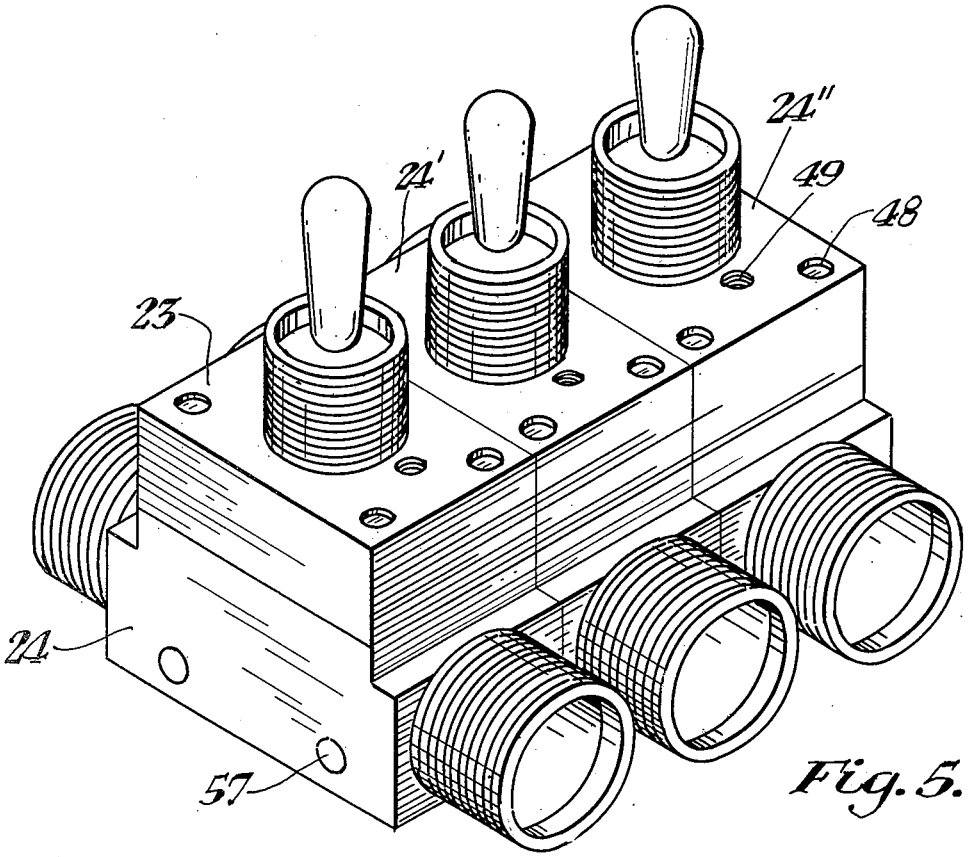
Fig. 5.
Fig. 9.
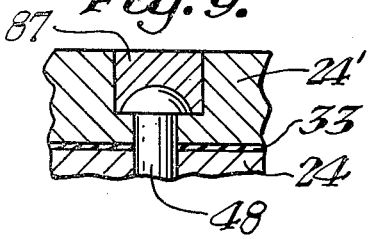
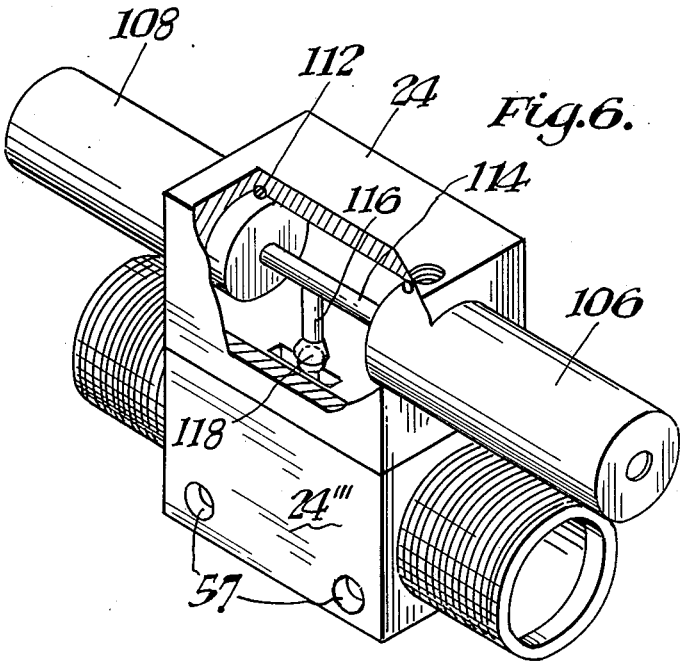
Fig. 6.
Fig. 10.
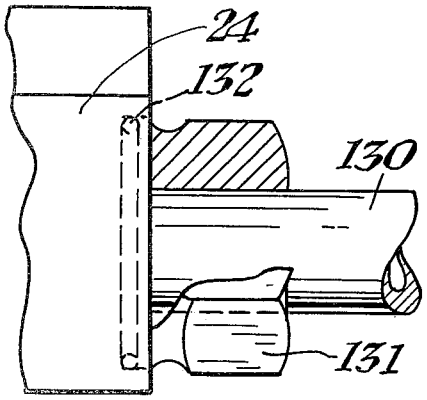

SERIES SLIDING CONTACT SWITCH

CROSS-REFERENCE TO RELATED APPLICATION

This application is a continuation-in-part of pending application Ser. No. 788,108, filed Apr. 14, 1977, now abandoned.

BACKGROUND OF THE INVENTION

In the past, many manual coaxial switches have been designed to connect a first high frequency coaxial line to other individual transmission lines. Such a device is shown in the Concelman U.S. Pat. No. 3,010,080. The disadvantage of this design is the parasitic inductance and capacitance interaction between the wheel contacts which cause the signal to arc just before contact. Therefore, the wheels will pit which will shorten the life of the switch considerably.

The wheel contact design also limits the actual contact area between the wheel, the secondary contacts and the input contacts to a very small area. This small contact area impedes the effectiveness of the switch in medium andhigh power ranges.

Various switch designs, such as the Concelman patent, have pinned pivot points on the handles of their switching assembly, thus permitting chips from the handle to accumulate in the switching contact area and create high frequency shorting of the signal from any one of the contacts to the body ground.

Further, designs have been proposed with reciprocating or slide action. Such a design in shown by O'Hara in U.S. Pat. No. 1,340,788. However, this switch tends to generate unwanted cross-interference between elements.

Another disadvantage of prior designs is that they permit moisture to enter the switch and remain in the contact area when used in high humidity environments.

SUMMARY OF THE INVENTION

The present invention affords a solution to the problems mentioned above by providing a moisture proof, ultra-high frequency coaxial switch that permits high power operation without parasitic inductance or capacitance interaction between the contacts.

The new and improved series sliding single pole contact switch which can be ganged to provide multiple switching includes an input contact pin having a generally slotted captivated contact with two receiving arms, at least two output contact pins also generally slotted each of which includes two receiving arms, a sliding contact mechanism including a sliding knife blade contact and a toggle assembly. The sliding knife blade contact is sized to fit into and bias the arms of each slotted contact outwardly. The sliding knife blade contact is always captively in contact with the centrally located slotted input contact pin. In the preferred embodiment the toggle assembly includes bias means to place the sliding contact in engagement with one of the two output contact pins to provide a series sliding, single pole, double throw contact switch. The captivated contact also cleans the arm of each slotted contact.

It is an object of this invention to provide UHF, BNC, N, TNC, F, SC, HN, QDS, LN, LC, LT, Micro Miniature, Sub Miniature and all other coax fittings switches with a sliding knife blade contact which is always captivated by the slotted input contact pins or feeder connector and one of two loads that can be connected to connectors, which can be of the BNC or other coaxial type. This sliding knife blade contact being captively held in the contact pins offers simplicity of design and minimizes contact wear and pitting which is usually associated with relay type contacts.

Yet another object of this invention is to provide a switch with greater switch contact surface area to permit high power operation without loss caused by pitting.

Another object of this invention is to provide an improved vibration resistant switch that permits superior transfer of radio frequency and video applications.

Still another object of this invention is to provide a liquid resistant coaxial switch.

A further object of this invention is to provide a ganged switch to provide multiple switching to a plurality of outputs.

Still a further object of this invention is to provide a switch which permits switching of frequencies up to 16 GHZ without appreciable losses.

In accordance with these and other objects which will be apparent hereinafter, the instant invention will now be described with particular reference to the accompanying drawings.

BRIEF DESCRIPTION OF THE DRAWINGS

FIG. 1 is a top view of the series contact switch with the switching assembly positioned in the mid-unstable position as it is moved from the left or right position.

FIG. 2 is a cross-sectional side view of FIG. 1 taken along lines II—II and looking in the direction of the arrows, and with a portion of the internal component illustrated and partially broken away, and phantom left and right stable switching assembly positions.

FIG. 3 is an end view of FIG. 1 that is identical to the opposite end view having a flexible moisture proof boot covering the handle.

FIG. 4 is a partial isometric view of the sliding knife contact and the output contact pins.

FIG. 5 is an isometric view of a plurality of the present switch ganged to provide a multiple pole switch.

FIG. 6 is an isometric view of the present switch with a solenoid control.

FIG. 9 is a cross-section of a fastening means securing the present switch together.

FIG. 10 is a cross-section of a switch directly connected or hard wired to coaxial cable.

DESCRIPTION OF THE PREFERRED EMBODIMENT

Figure 7:
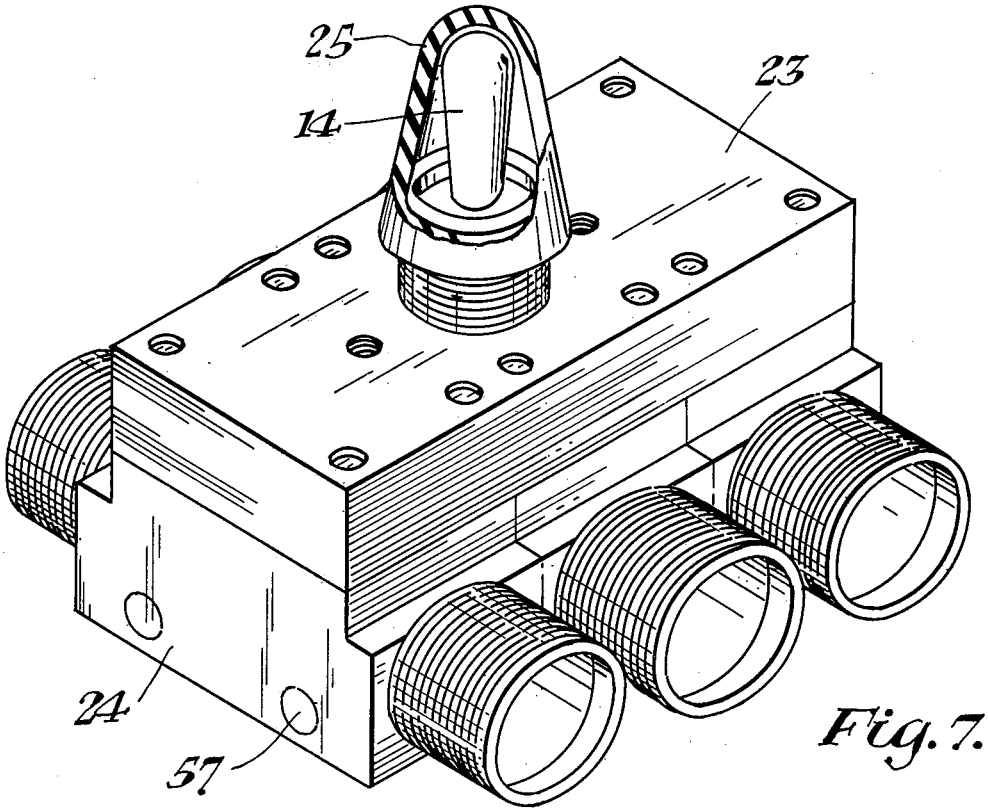
FIG. 7 is an isometric view of the present switch ganged and having a single switching assembly.

Referring now particularly to FIGS. 1 and 2, the series switch 10 includes a generally rectangular body 24 with coaxial connector portions 54 and 56 in a horizontal plane which can be switched from a coaxial feeder line connected to a connector 58 at the bottom as shown in FIG. 2. Said body 24 has a plurality of through bolt holes 57 which permit the ganging of a plurality of coaxial switches. The body 24 has an inner cavity 60 created by a longitudinal cylindrical through bore 62, a cylindrical through bore 27 in the bottom perpendicular to longitudinal bore 62, and the slide contact assembly guide 66 on the top. The switch is designed so that the cavity 60 maintains the absolute integrity of the impedence in a coaxial line system. The top cover plate 23 of the body 24 has a toggle assembly 11 fastened to it by a plurality of screw fasteners 48. Brass plugs 87 or retainers may be pressed into the cavity above the fasteners 48 as shown in FIG. 9. A silicon rubber adhesive 33 may be placed between the top cover plate 23 and the body 24 to insure the water tight integrity of the switch 10. Apertures 49 are tapped holes that may be used in connecting the switch 10 to a control panel in conjunction with fasteners 13 and 15. When fastened to a panel by screws in said holes 49, the switch 10 will not rotate. The biasing spring 16 forces the handle 14 against the toggle assembly 11 and allows pivoting of handle 14 without the use of fasteners, thus eliminating chips from falling into inner cavity 60. Female pins 26, 32, and 38 are held in the connector portions 54, 56, and 58 by insulators 28, 30, 34, 36, 40, and 42. The outer insulators 28, 34, and 40 are counter-sunk to permit the pin flange to be flush with the inner end of the outer insulators 28, 34, and 40 thereby preventing an air gap between the outer insulators 28, 34, and 40 and the inner insulators 30, 36, and 42. The pin flange 74, 76, and 78 prevents the female pins 26, 32, and 38 from being pushed out of the insulators 28, 30, 34, 36, 40 and 42 when connecting coaxial cables to the connectors 54, 56, and 58. O-rings 55 may be inserted against flanges 74, 76, and 78 to seal the cavity 60 against moisture. The outer insulators 28, 34, and 40 have a middle section with a larger diameter than the ends. This larger diameter middle section prevents the outer insulators 28, 34, and 40 from being pushed into the inner cavity 60 by stopping against a smaller through bore. The outer insulators 28, 34, and 40 are prevented from being retracted from the connectors 54, 56, and 58 by rings 46, 47, and 45 which fit into machined grooves inside the connectors 54, 56, and 58 and have a smaller inside diameter than the diameter of the middle section of the outer insulators 28, 34, and 40. The singular design of body 24 allows the connectors 54, 56, and 58 to be silver soldered to the body as shown in FIG. 2 at flange 59.

The inner ends of the female pins 26, 32, and 38 protrude into the inner cavity 50 and are cut along an axial plane 80, in a generally slotted configuration to allow the slide contact 50 to connect the feeder line connector 58 to a load connected to one of the horizontal connectors 54 and 56. Low cross talk is accomplished because of the low capacitance due to the slide contact 50 facing the air gap of the axial cut in the pins 26 and 38 as illustrated in FIG. 4. The slide contact 50 is always captively in contact with the bottom feeder line pin 32 since the slide contact assembly 44 is restricted from moving in an upward direction by the toggle handle 14 and the downward force exerted on the contact assembly ball 20 by the spring 16. The slide contact assembly 44 is restricted in its lateral movement by the slide contact assembly guide 66 and the slide contact insulator guide 82. This restriction insures a positive connection between the slide contact 50 and the horizontal female pins 26 and 38.

When the toggle handle 14 is in the phantom line position 14' to the left, the slide contact 50 has moved into the inner axial cut 80 of the right horizontal female pin 38, shown in phantom thereby connecting the right coaxial cable load to the feeder line. The toggle handle 14 is prevented from moving from its selected position by the force of the spring 16 against the contact assembly ball 20 unless positive operator action is taken to move the toggle handle 14 to the right. The toggle handle 14 is prevented from remaining in the neutral position by the toggle handle post 22 which raises the toggle handle 14 off of the slide contact insulator 52 when the toggle handle 14 is in a vertical position thereby causing the handle 14 to become unstable and seek a positive position to the left 14' or right 14''.

When the switch is used in high-humidity environments, moisture is prevented from entering the inner cavity 60; first, by the handle 14 being biased against the top of the toggle assembly 11, second, by the slide contact insulator 82 sealing the inner cavity 60, and third, by the flexible boot 25 which is secured over the handle 14 by an internal threaded ring threaded onto the threaded portion of the toggle assembly 11, the O-rings 55 and the gasket 33 between the top cover plate 23 and the body 24. This sealing gives a military specification to a switch in regard to salt spray tests for reliability.

Figure 8:
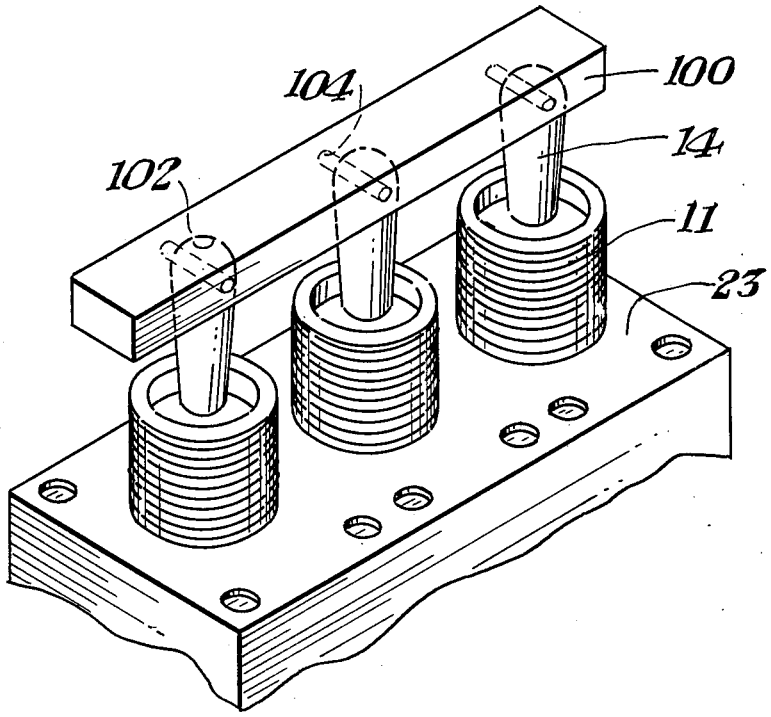
FIG. 8 is an isometric view of a plurality of the present switch ganged together and having a gang bar.

It should be noted that the two holes 57 in the side of body 24 allow ganging of a plurality of switches. The bodies may be ganged in various series arrangements to make SPDT, DPDT, TPDT devices as illustrated in FIGS. 5, 7, and 8. A gang bar 100 may be connected to two or more independent toggle assemblies 11. The bar 100 includes apertures 102 for receiving handles 14. The bar 100 is secured to the handles 14 by fastening means 104 through apertures 102. The cover plates 23 may be easily removed and changed to add ganging features. Also the cover plate 23 may be easily removed to remove the toggle switch in order to replace it by a solenoid operated device. The erector set ability of body 24 and the removability of the switch for altering the device when ganged or for solenoid control are additional features of this device.

Further, in DPDT switches a terminating resistor, not shown, may be built in using 50, 75, or 100 ohm noninductive resistors for example. Such a switch can terminate a coaxial line, as in video applications. This may be done by removing the slotted, U-shaped pin and replacing it with a resistor to terminate a coaxial line.

As illustrated in FIG. 7, when the switches are ganged and the toggle assembly 11 and upper plates 23 are removed, a single toggle 11' and upper plate 23' may be used. Internally a bar will connect each knife member as shown in FIG. 4 to the single handle 14 movable from above the upper plate 23'. The upper plate would be twice as high and all the upper ball members (as shown in FIG. 4) are connected to a common bar with an upper ball that is actuated by a single handle.

In FIG. 6, if a solenoid is used, the toggle assembly 11 on body 24''' is removed and replaced by a solenoid means. The solenoid means is two pull type solenoids 106 and 108 designed to be screwed into the switching assembly 10 against O-rings 112. A common push-pull rod 114 extends into both solenoids and includes a mover 116 having a socket 118 that moves ball 120. This arrangement allows the solenoid coils to be replaced without changing the rod 114. The solenoid may be energized into a first or second position. The disclosed switch will handle up to 1,000 watts of R.F. power.

It should be noted that the handle of the toggle may be replaced by a well known aircraft type locking detent.

FIG. 10 discloses the toggle lock arrangement that allows the coaxial line 130 to be stripped and placed in the body 24. When the locking means 131 is screwed into the body 24 it locks the line into the switch. Gaskets 132 are used to waterproof the device.

The switch system concept of the erector set switch provides unlimited configurations for switch requirement. This ability allows the system to be built by the silver soldering of any one of a plurality of connectors to be mated with the main body. This reduces the stock on hand of the connectors. This arrangement reduces the weight of the switch that is important in aircraft applications. Therefore, literally thousands of switching arrangements may be used. The body 24 is zinc dicasting, premachining brass, navel brass and stainless steel. This allows the switch to be used in all known applications.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An ultra-high frequency building block series sliding contact switch, comprising:

a body, said body having a watertight, sealed cavity and at least two apertures therethrough for ganging said switch, said body having a cavity covering portion connected to said body, a sliding contact mechanism connected to said body and positioned in said cavity including a single generally rectangular sliding knife blade having a bottom contact portion and end contact portions, an input contact connecting means connected to said body, said input contact connecting means including a feeder connection portion of any design for connnecting an input cable and an input contact portion including a slot positioned to always captively contact said bottom contact portion of said generally rectangular sliding thin knife blade, at least two output contact connecting means connected to said body, each said output contact connecting means including a load connection portion of any design for connecting an output cable and a slotted output contact portion sized for receiving said end portion of said generally rectangular sliding knife blade contact, said generally rectangular sliding knife blade sized to be captively in contact and bridge said bottom contact portion and one end contact portion, a switching assembly removably connected over said cavity to said sliding contact mechanism for longitudinally moving said end portions of said generally rectangular sliding knife blade contact into and out of engagement with said slotted ouput contact portion, said switching assembly includes a toggle switch arm and a biasing means connected between said arm and said sliding contact mechanism, said biasing means for biasing said sliding contact mechanism into one or the other said end contact portion engaging positions and for positioning said toggle arm in said cavity covering portion, a flexible covering means removably secured to said switching assembly for excluding foreign material from said sliding contact mechanism.

2. An ultra-high frequency building block series sliding contact switch as set forth in claim 1, wherein:

said output contact portion is cut along an axial plane in a generally fixed opened slotted configuration to receive said end portion of said generally rectangular sliding knife blade contact.

3. An ultra-high frequency building block series sliding contact switch as set forth in claim 2, wherein:

said slotted configuration of said output contact portion and each said end portion of said generally rectangular sliding knife blade contact is shaped to provide maximum initial peripheral contact area between their respective rectangular surfaces.

4. An ultra-high frequency building block series sliding contact switch as set forth in claim 1, wherein:

said apertures are bolt holes unconnected to said cavity to allow ganging of a plurality of switches, a plurality of said sliding contact switches ganged together by bolts connected in said bolt holes and including only one removable switching assembly connected to said sliding contact mechanism of each said sliding contact switches for switching all ganged switches.

5. An ultra-high frequency series sliding contact switch as set forth in claim 1, wherein:

said flexible covering means including a rubber boot having an internal fastener for removably securing said boot to said cavity covering portion and over said toggle arm.

* * * * *